US006105727A

United States Patent [19]

Nakao

[11] Patent Number: 6,105,727

[45] Date of Patent: Aug. 22, 2000

[54] CARRYING APPARATUS

[75] Inventor: Takashi Nakao, Neyagawa, Japan

[73] Assignee: Murata Kikai Kabushiki Kaisha, Kyoto, Japan

[21] Appl. No.: 09/261,741

[22] Filed: Mar. 3, 1999

[30] Foreign Application Priority Data

May 20, 1998 [JP] Japan ..... 10-156797

[51] Int. Cl.[7] ..... B66B 11/04

[52] U.S. Cl. ..... 187/251; 187/250

[58] Field of Search ..... 187/233, 224, 187/250, 414, 251; 901/21; 414/618, 619

[56] References Cited

U.S. PATENT DOCUMENTS

| | | | |
|---|---|---|---|
| 4,208,619 | 6/1980 | Delebecque et al. | 901/21 X |
| 4,844,679 | 7/1989 | Teranishi | 414/618 X |
| 4,865,516 | 9/1989 | Focke et al. | 901/21 X |
| 4,968,214 | 11/1990 | Shiotani | 901/21 X |
| 5,402,862 | 4/1995 | Rosenkranz | 187/233 X |
| 5,533,858 | 7/1996 | Costa | 901/21 X |
| 5,562,393 | 10/1996 | Focke et al. | 901/21 X |

FOREIGN PATENT DOCUMENTS

| | | | |
|---|---|---|---|
| 8904744 | 6/1989 | European Pat. Off. | 901/21 |
| 0092276 | 4/1991 | Japan | 901/21 |
| 0117579 | 5/1991 | Japan | 901/21 |
| 7-330115 | 12/1995 | Japan . | |
| 9-150912 | 6/1997 | Japan . | |

*Primary Examiner*—Robert P. Olszewski
*Assistant Examiner*—Steven B. McAllister
*Attorney, Agent, or Firm*—Armstrong, Westerman, Hattori, McLeland & Naughton

[57] ABSTRACT

To eliminate the use of a bellows for sealing a slit of a carrying apparatus. A toothed belt 8 for elevating an elevator 6 is used as a seal of a slit 7, and a total of four idle pulleys (2 each) are provided at the upper and lower parts of a driving pulley, so that a flat face of a toothed belt 8 appears on the slit 7.

3 Claims, 6 Drawing Sheets

CARRYING APPARATUS

FIELD OF THE INVENTION

The present invention relates to a carrying apparatus that can be used in a clean room or the like, and more particularly to prevention of dust leakage from a slit of the carrying apparatus.

BACKGROUND OF THE INVENTION

A carrying apparatus used in a clean room or the like moves a moving unit such as an elevator in a state in which said moving unit is extruded from a slit. Of course, in such a clean room, it is important to prevent dust from being generated, and it is necessary to seal the slit to prevent the dust generated inside the carrying apparatus from leaking from the slit. With respect to this point, it is known that a pair of bellows can be provided on both sides of the moving unit, and said bellows can be expanded and contracted by movement of the moving unit so as to seal the slit. However, there is a problem in that the size of the carrying apparatus is increased to provide a storage space for the bellows, and dust is generated due to abrasion of the bellows. Furthermore, there is another problem in that the durability of the bellows is reduced by repeated expansion and contraction, resulting in an increased maintenance frequency of the carrying apparatus.

It is an object of the present invention to use a driving belt of a moving unit for a sealing member of a slit, thereby eliminating the need for an exclusive sealing member and miniaturizing the carrying apparatus.

It is another object of the present invention to provide a specific mechanism when the moving unit is employed as an elevator.

It is yet another object of the present invention to make use of a position detecting belt of the moving unit as the sealing member of the slit, thereby eliminating the need for an exclusive sealing member and miniaturizing the carrying apparatus.

SUMMARY OF THE INVENTION

The present invention is characterized in that a belt is used as a sealing member of a slit for a carrying apparatus adopted to move a moving unit extruded from a slit by belt driving.

Preferably, the moving unit is an elevator provided with a driving pulley, said belt is a vertically arranged toothed belt, and the driving pulley is geared with the belt so as to elevate the elevator. Also, preferably, a total of four idle pulleys are provided, two each at the upper and lower parts of the driving pulley, so that a flat face of a toothed belt appears on the slit side.

The present invention is characterized in that the belt is used as the sealing member of the slit for a carrying apparatus provided with a belt for detecting the position of a moving unit extruded from a slit. A rotary encoder or the like may be employed for position detection using the belt.

In the present invention, the moving unit is an elevator or a horizontal movement base or the like of the carrying apparatus. Since sealing the slit is particularly problematic, a case in which the elevator is employed as a moving unit is particularly important. In addition, it is particularly important that a carrying apparatus for a clean room be designed from the viewpoint of prevention of dust being generated from the slit. However, the apparatus described is not limited to an apparatus for a clean room.

In the present invention, a belt for driving a moving unit is used as a sealing member of a slit. This makes it possible to eliminate the exclusive sealing member and miniaturize the carrying apparatus, and prevents problems such as dust generation from bellows or fatigue of the bellows.

Preferably, the moving unit is an elevator provided with a driving pulley, the belt is a vertically arranged toothed belt, and the driving pulley is geared with the belt so as to elevate the elevator. Such a toothed belt is capable of precisely controlling the position of the elevator. Also, preferably, in addition to the driving pulley, four idle pulleys are disposed around the driving pulley, so that a flat face opposite to the toothed face appears on a slit side when the driving pulley is geared with a toothed face of the toothed belt. The toothed belt may be an endless belt or a fixed belt with both ends fixed at the upper and lower parts of the carrying apparatus.

In the present invention, a belt for detecting the position of a moving unit extruded from a slit of a carrying apparatus is used as a sealing member of the slit. To detect the position of the carrying apparatus, in the case where the moving unit is fixed to the belt, a rotary encoder or the like may be provided, thereby detecting feeding of the belt or the like. In addition, in the case where the moving unit is not fixed to the belt, the moving unit may be provided with a rotary encoder or the like, thereby detecting rotation relative to the belt.

In the present invention, a belt for detecting the position of the moving unit can be used as the sealing member of the slit, thereby making it possible to miniaturize the carrying apparatus and preventing problems such as dust being generated from the bellows or the like or fatigue of the bellows.

DETAILED DESCRIPTION OF THE PREFERRED EMBODIMENTS

Figure 1:
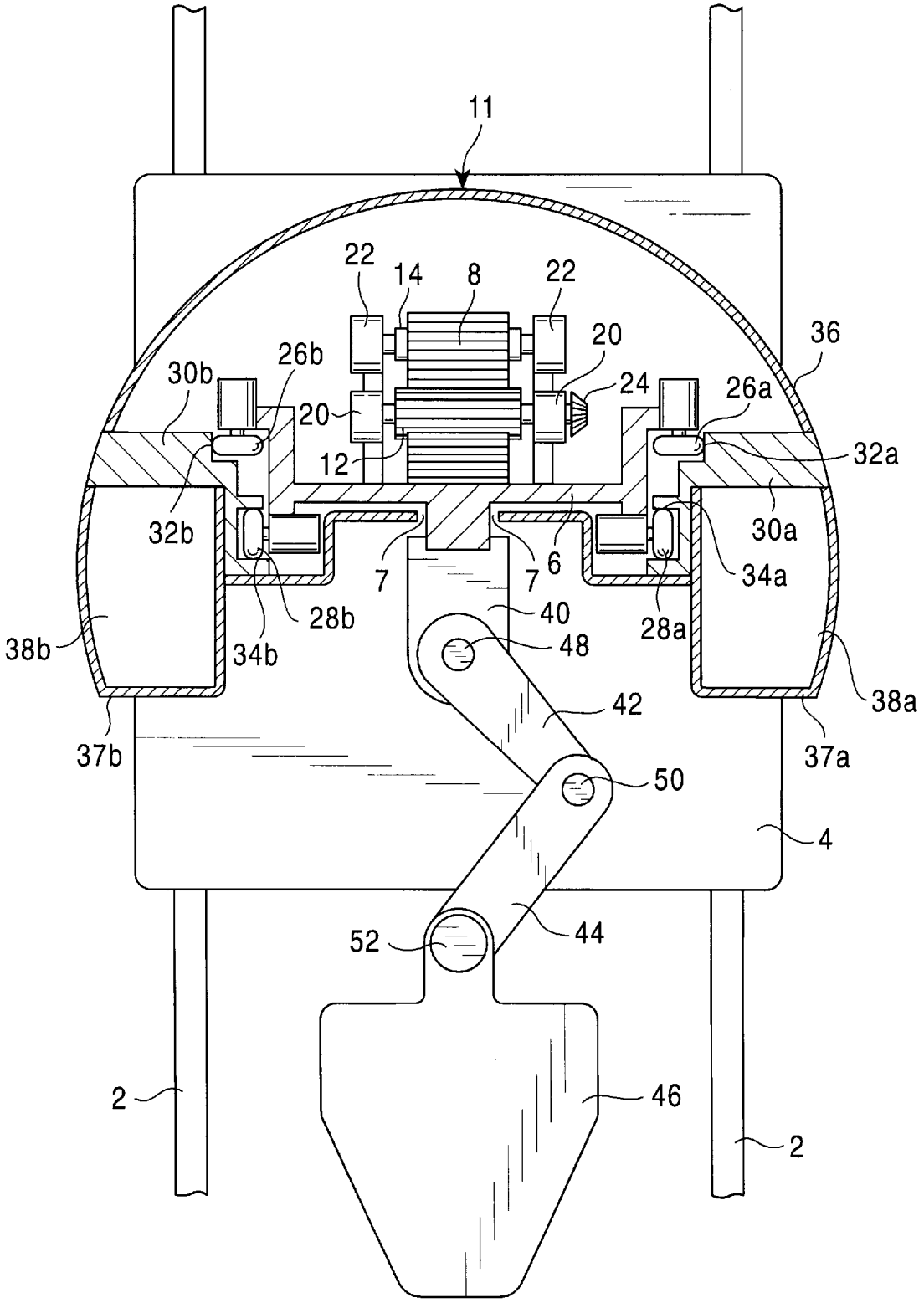
FIG. 1 is a horizontal sectional view of a carrying apparatus according to an embodiment.
Figure 2:
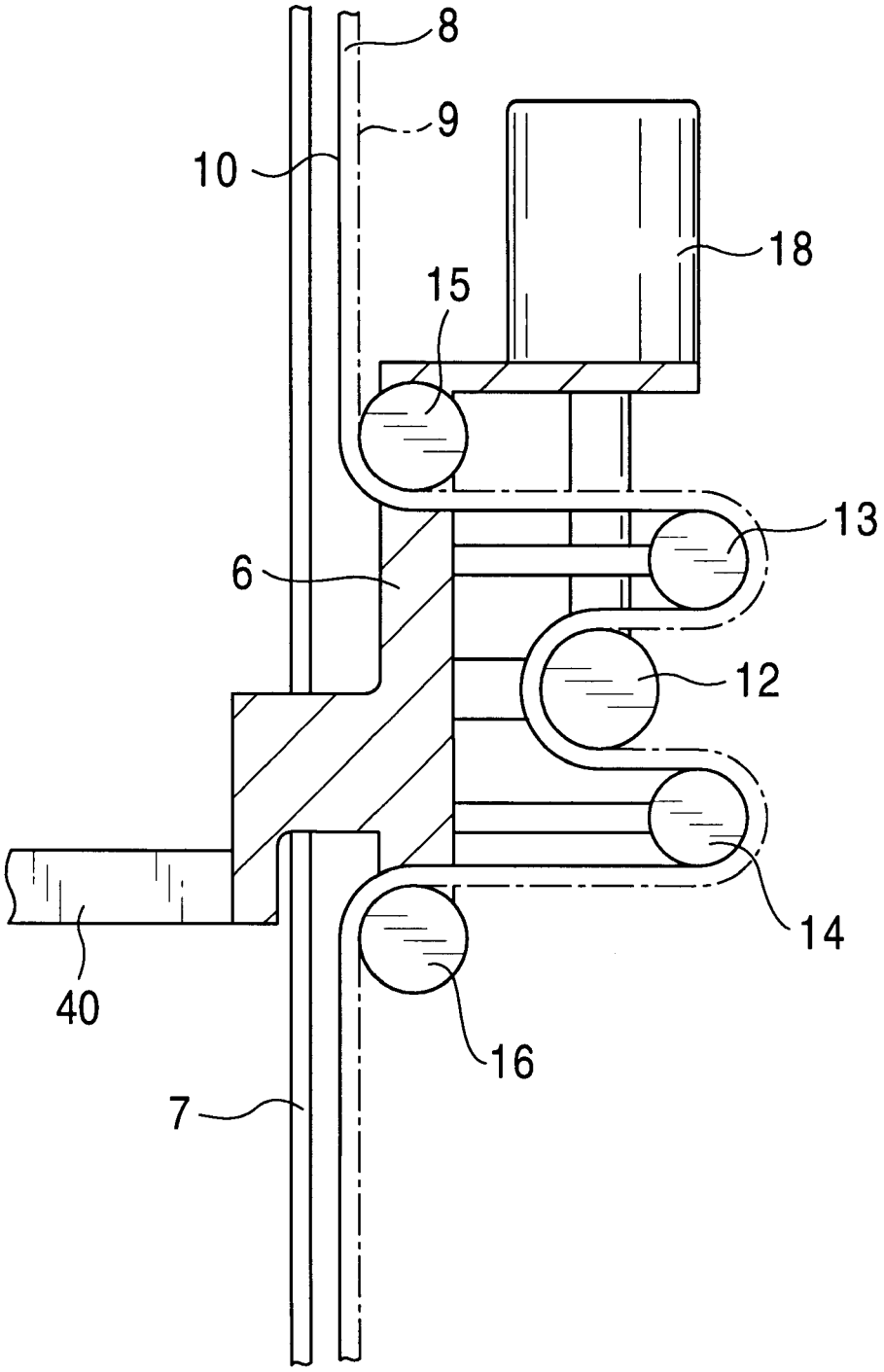
FIG. 2 is a sectional view of essential portions of a carrying apparatus according to an embodiment.
Figure 3:
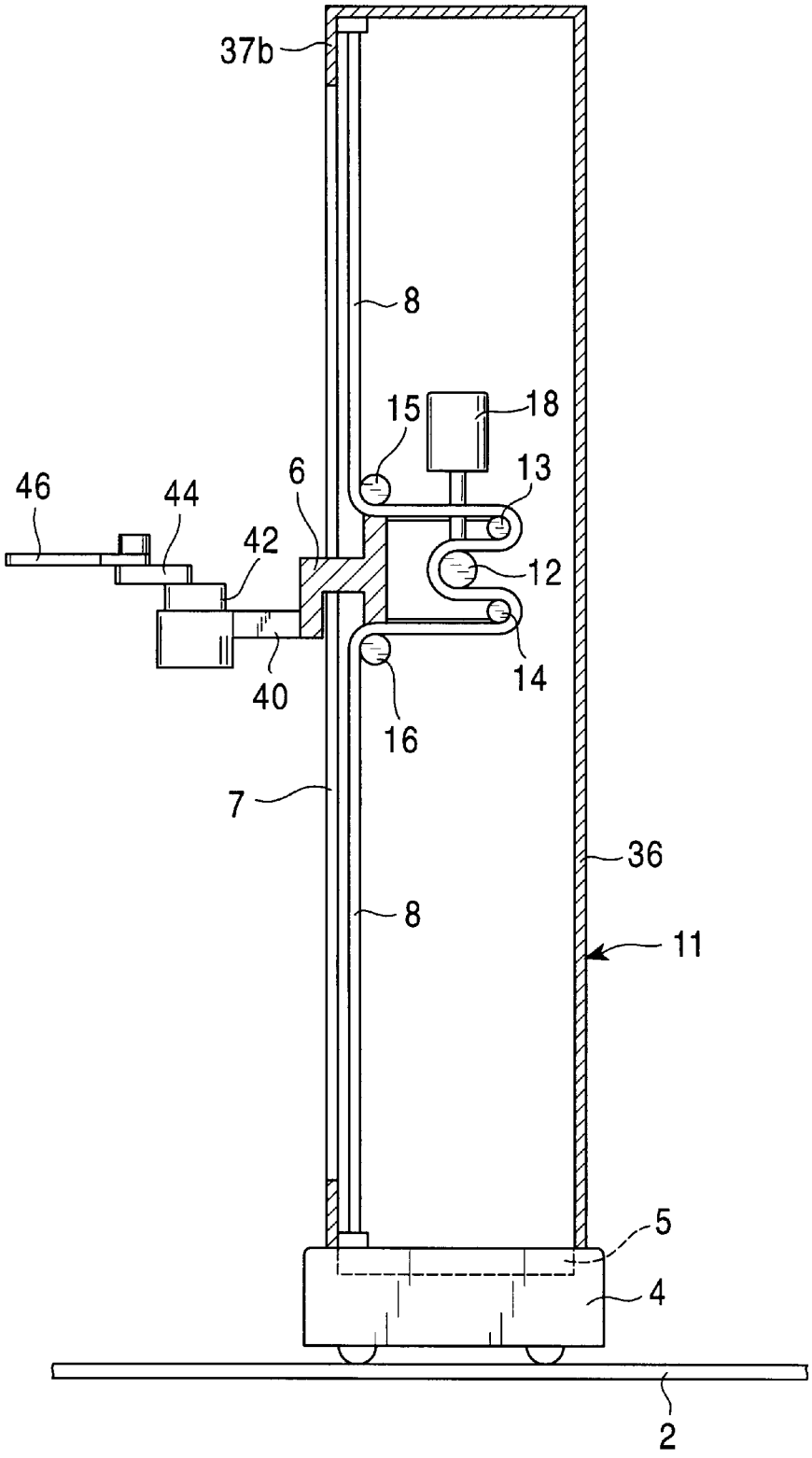
FIG. 3 is a sectional view schematically showing the entire structure of a carrying apparatus according to an embodiment.

In FIGS. 1 to 3, 2 is a rail, for example, installed on a floor surface of a clean room, and 4 is a horizontal traveling portion of the carrying apparatus that horizontally travels on the rails 2. 5 is a turntable, 6 is an elevator, 7 is a slit for extending a protruding part of the elevator 6, 8 is a toothed belt for elevating the elevator 6, 9 is a toothed face of the belt, and 10 is a flat face of the belt. As shown in FIG. 2, the flat face 10 appears on the side of the slit 7. 11 is a mast on the turntable 5 that houses the elevator 6 or the like.

The elevator 6 is provided with four idle pulleys 13 to 16 in addition to a driving pulley 12, the driving pulley 12 and the idle pulleys 15 and 16 are geared with the toothed face of the toothed belt 8, and the idle pulleys 13 and 14 come into contact with the flat face 10 of the toothed belt 8. Therefore, the flat face 10 of the toothed belt 8 can be seen from the slit 7, improving the appearance and preventing the toothed face 9, which is likely to generate dust, from being exposed to the outside. 18 is an elevation motor provided on the elevator 6, and 20 and 22 in FIG. 1 are bearings of the pulleys 12 to 16. A bevel gear 24 is connected to a shaft of the driving pulley 12, and is geared with a bevel gear of a shaft protruding from the elevation motor 18 in FIG. 2, thereby rotating the driving pulley 12.

The elevator 6 is elevated by using the toothed belt 8. In FIG. 1, traverse positioning is performed by means of rollers 26*a* and 26*b*, and longitudinal positioning is performed by means of rollers 28*a* and 28*b*. Guide members 30*a* and 30*b* are provided corresponding to the positioning, and the rollers 26*a*, 26*b*, 28*a*, 28*b* are guided by means of guide rails 32*a*, 32*b*, 34*a*, 34*b* provided therefor. 36 is a rear cover, 37*a* and 37*b* are side covers, and 38*a* and 38*b* are cavity portions used to draw in air contaminated through elevation or the like of the elevator 6 and conduct the air to a clean fan unit or the like (not shown in the drawings).

The elevator 6 is provided with a transfer base 40 to move a hand 46 forward and backward via a pair of arms 42 and 44. 48, 50, and 52 are turning shafts for the arms 42, 44 and the hand 46. The arms 42 and 44 turn in opposite directions. If the turning angle of the arm 42 is assumed 1, that of the arm 44 is −2, and that of the hand 46 is 1. Therefore, the hand 46 moves forward and backward from the transfer base 40 in the same direction, making it possible to transfer an article loaded on a rack or the like (not shown in the drawings) with minimum interference.

According to effects of the embodiments, as shown in FIG. 2, the driving pulley 12 rotates while it is geared with the toothed face 9 of the toothed belt 8, thereby elevating the elevator 6 vertically along the slit 7. At this time, due to the presence of the idle pulleys 13 to 16, the flat face 10 of the toothed belt 8 appears on the side of the slit 7, improving the appearance and preventing dust generated by abrasion of the toothed face 9 from being discharged. The longitudinal and traverse positions of the elevator 6 are restrained by means of guide rollers 26*a*, 26*b*, 28*a*, 28*b*, and the contaminated air in the cover 36 is conducted to a clean fan unit via cavities 38*a* and 38*b* or the like and treated.

Here, the toothed belt 8 can be used as a seal of the slit 7, making it possible to eliminate the need for an exclusive sealing member such as bellows and to miniaturize the carrying apparatus by eliminating the storage space for the bellows or the like. In addition, this makes the apparatus free from dust generated due to abrasion of the bellows and free from fatigue due to repeated expansion and contraction of the bellows.

In the present invention, it is important that a belt for elevating or detecting the position of an elevator is used as a seal of the slit 7. The belt may be a fixed belt with the top and bottom fixed or an endless belt.

Figure 4:
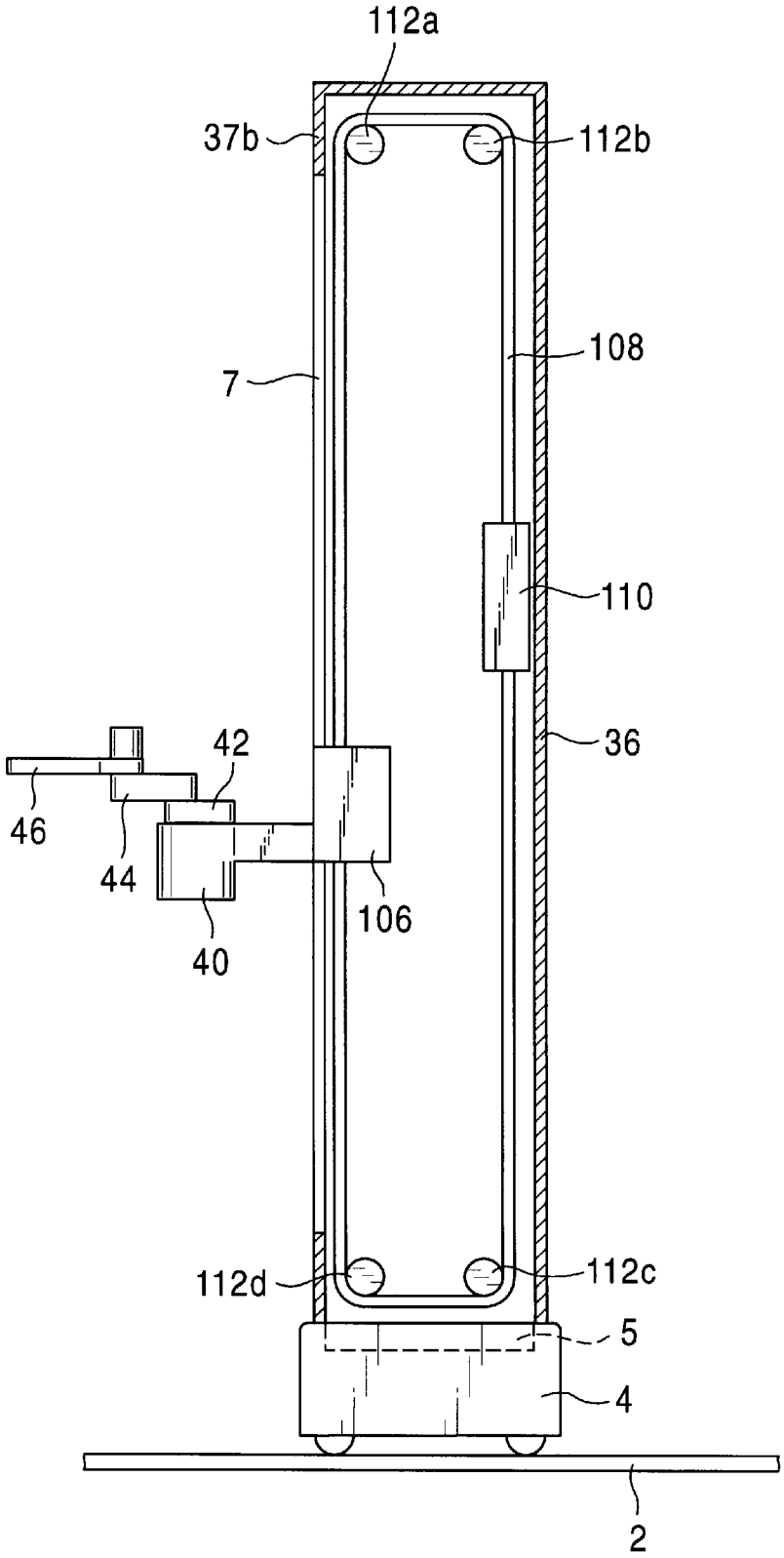
FIG. 4 is a sectional view schematically showing the entire structure of a carrying apparatus according to a first modified example.

FIG. 4 shows a modified example with a toothed endless belt 108. 110 is a counterweight, and 112*a* to 112*d* are pulleys, one of which is a driving pulley adopted to fix the elevator 106 to the toothed endless belt 108 and elevate the elevator 106. In this modified example, the counterweight 110 may be employed, thus making it easy to elevate the elevator 106. In both of the embodiments and modified examples, the toothed belt 8 and the toothed endless belt 108 are employed, making it possible to ignore slippage between the belt and the pulley and detect the positions of the elevators 6 and 106 from the rotation speed, etc. of the pulleys 12 and 112*d*.

Figure 5:
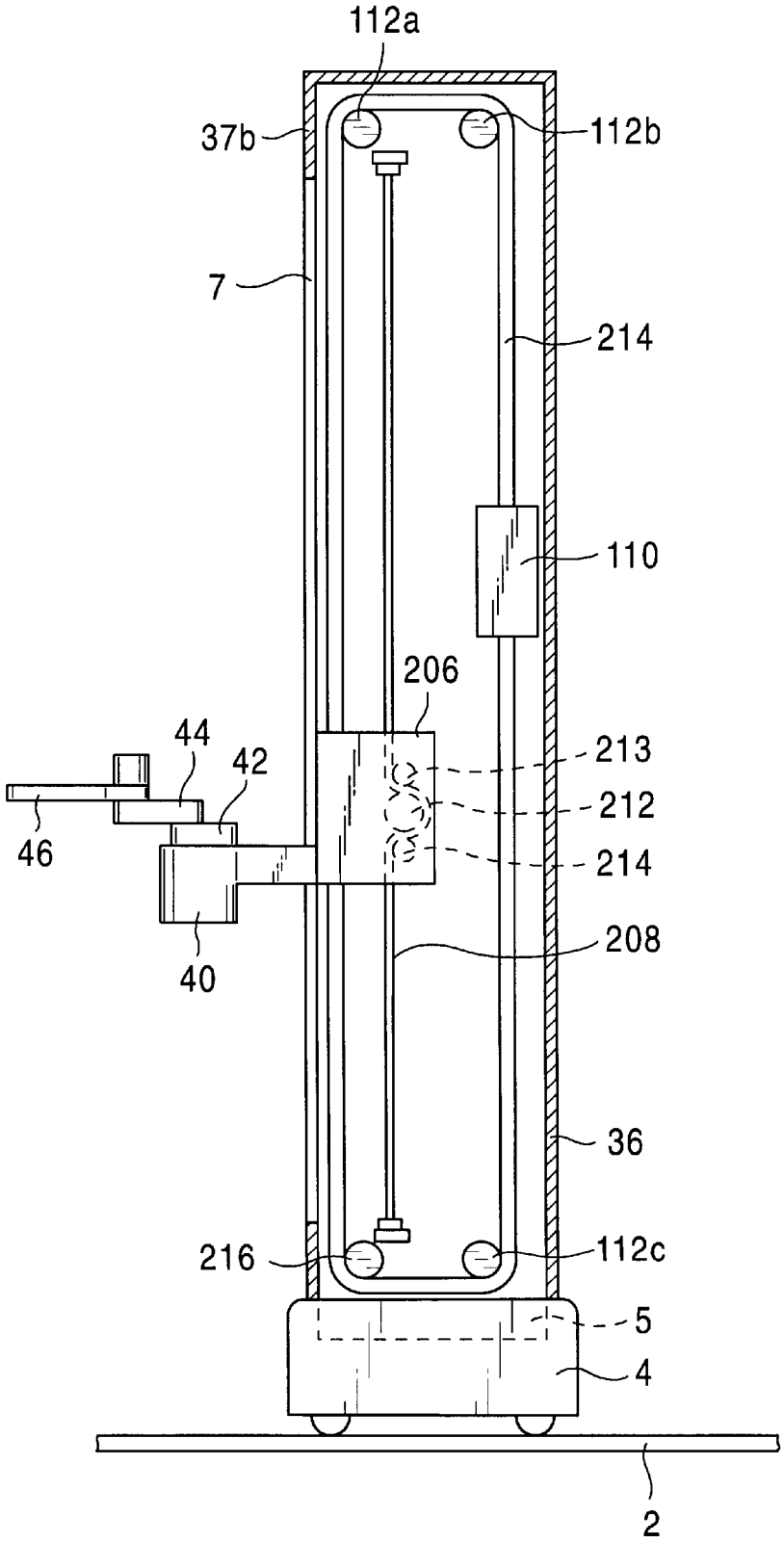
FIG. 5 is a sectional view schematically showing the entire structure of another carrying apparatus according to a second modified example.

FIG. 5 shows a modified example in which a belt 214 for detecting the position of an elevator is provided. An elevator 206 is fixed to the belt 214, the belt 214 is fed by employing three pulleys 112*a* to 112*c* and a rotary encoder 216, and the position of the elevator 206 is detected by means of the rotary encoder 216. 208 is a toothed belt similar to the toothed belt 8. A driving pulley 212 and two idle pulleys 213 and 214 are employed to rotate the driving pulley 212 in a mechanism similar to the embodiments shown in FIGS. 1 to 3 and elevate the elevator 206. The belt 214 appears at the slit 7, thus eliminating the idle pulleys 15 and 16. In addition, the counterweight 110 is employed, making it easy to elevate the elevator 206.

Figure 6:
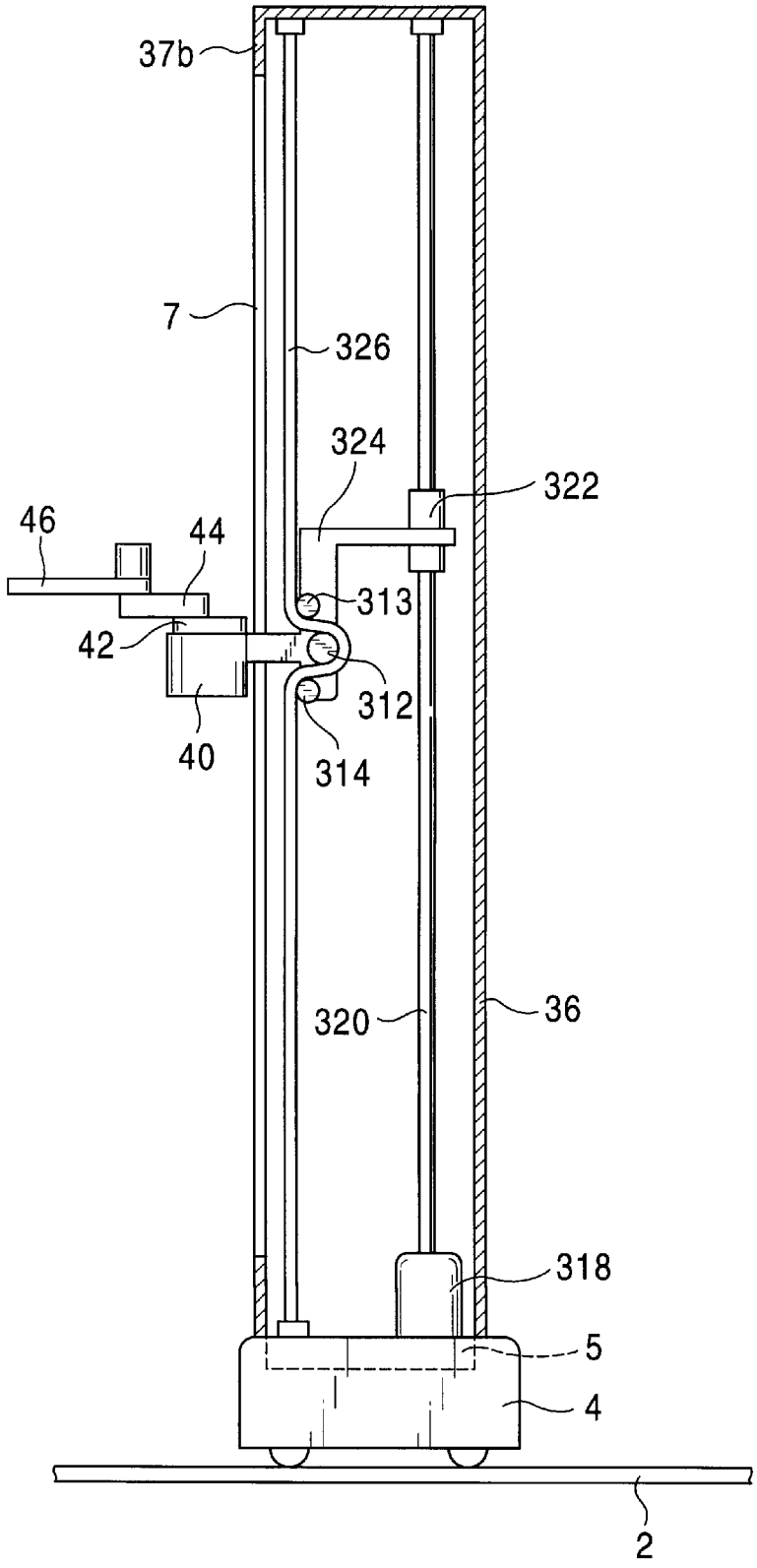
FIG. 6 is a sectional view schematically showing the entire structure of yet another carrying apparatus according to a third modified example.

FIG. 6 shows a modified example in which a ball screw 320 and an elevation motor 318 are employed. In this modified example, the ball screw 320 is rotated by means of the elevation motor 318, and a female screw portion 322 is employed to elevate an elevator 324. On the elevator 324, a rotary encoder 312 and two idle pulleys 313 and 314 are disposed, and a belt 326 is employed to detect the height of the elevator 324 by means of the rotary encoder 312. Points other than the above are similar to the embodiments shown in FIGS. 1 to 3.

What is claimed is:

1. A carrying apparatus, comprising:

an elongate casing having a slit extending in a longitudinal direction of said elongate casing;

a moving unit provided in said elongate casing so as to be reciprocally moved along said longitudinal direction, said moving unit having an arm portion outwardly extended through said slit;

a toothed belt for driving said moving unit, said toothed belt having a flat face and a toothed face; and a plurality of pulleys for arranging said toothed belt in said elongate casing, at least one of said plurality of pulleys being a driving pulley driven by a motor and engaged with said toothed face of said toothed belt, wherein said toothed belt is disposed so as to cover said slit from an inside of said slit with said toothed face facing inwardly, and wherein said moving unit is an elevator provided with said driving pulley engaged with said toothed face of said toothed belt vertically arranged so as to elevate said elevator.

2. The carrying apparatus as recited in claim 1, wherein said plurality of pulleys include said driving pulley and two idler pulleys provided above and below said driving pulley.

3. The carrying apparatus as recited in claim 1, further comprising a position sensor which acts in combination with said toothed belt for detecting a position of said moving unit.

* * * * *